US012644380B2

(12) United States Patent
Chau et al.

(10) Patent No.: US 12,644,380 B2
(45) Date of Patent: Jun. 2, 2026

(54) INGROUND DEVICE WITH ADVANCED TRANSMIT POWER CONTROL AND ASSOCIATED METHODS

(71) Applicant: Merlin Technology, Inc., Kent, WA (US)

(72) Inventors: Albert W. Chau, Woodinville, WA (US); Jason Pothier, Auburn, WA (US)

(73) Assignee: Merlin Technology, Inc., Kent, WA (US)

( * ) Notice: Subject to any disclaimer, the term of this patent is extended or adjusted under 35 U.S.C. 154(b) by 294 days.

(21) Appl. No.: 16/841,641

(22) Filed: Apr. 6, 2020

(65) Prior Publication Data

US 2020/0232317 A1 Jul. 23, 2020

Related U.S. Application Data

(63) Continuation of application No. 16/297,634, filed on Mar. 9, 2019, now Pat. No. 10,648,326, which is a continuation of application No. 14/213,644, filed on Mar. 14, 2014, now Pat. No. 10,240,456.

(60) Provisional application No. 61/798,139, filed on Mar. 15, 2013.

(51) Int. Cl.
*E21B 47/13* (2012.01)
*E21B 7/04* (2006.01)

(52) U.S. Cl.
CPC ..... *E21B 47/13* (2020.05); *E21B 7/046* (2013.01)

(58) Field of Classification Search
CPC ..... E21B 47/13; E21B 7/046
See application file for complete search history.

(56) References Cited

U.S. PATENT DOCUMENTS 3,597,680 A * 8/1971 Haddon ..... G01V 3/15 324/67
3,906,504 A 9/1975 Guster
4,054,881 A * 10/1977 Raab ..... G01B 7/004 324/227
4,314,251 A * 2/1982 Raab ..... G01S 1/08 340/979
4,361,192 A * 11/1982 Trowsdale ..... E21B 7/046 33/312
4,646,277 A * 2/1987 Bridges ..... E21B 4/145 173/4

(Continued)

FOREIGN PATENT DOCUMENTS

WO 2007/019319 A1 2/2007
WO 2007016687 A1 2/2007

OTHER PUBLICATIONS

Wikipedia, Pulse-width modulation (Year: 2021).*

(Continued)

*Primary Examiner* — Quang Pham
(74) *Attorney, Agent, or Firm* — Pritzkau Patent Group LLC; Michael M. Pritzkau

(57) ABSTRACT

An inground housing supports a transmitter for receiving electrical power from a battery. The transmitter transmits at least one signal using at least two different transmit power levels for at least one of locating the transmitter and characterizing an orientation of the transmitter. Based on detecting the battery voltage, the transmitter selects one of the transmit power levels. Transmitter output power can be controlled based on one or both of signal gain and duty cycle.

9 Claims, 6 Drawing Sheets

(56) References Cited

U.S. PATENT DOCUMENTS 4,839,644 A * 6/1989 Safinya ..... E21B 47/13 340/854.6
5,065,098 A * 11/1991 Salsman ..... G01V 3/15 324/67
5,086,508 A 2/1992 Furuno
5,264,795 A * 11/1993 Rider ..... G01V 3/06 324/67
5,337,002 A * 8/1994 Mercer ..... E21B 47/024 324/67
5,467,083 A * 11/1995 McDonald ..... E21B 47/13 340/854.6
5,564,101 A * 10/1996 Eisfeld ..... G07C 9/00182 455/352
5,720,354 A * 2/1998 Stump ..... E21B 47/0232 175/45
5,878,824 A * 3/1999 Mercer ..... E21B 7/06 175/24
5,982,151 A * 11/1999 Nagai ..... H02J 7/0029 323/299
6,002,258 A * 12/1999 Mercer ..... G01V 3/15 324/326
6,005,532 A 12/1999 Ng
6,008,651 A * 12/1999 Mercer ..... E21B 47/0232 324/326
6,035,951 A * 3/2000 Mercer ..... E21B 47/0232 175/45
6,079,506 A * 6/2000 Mercer ..... E21B 47/024 175/45
6,223,826 B1 * 5/2001 Chau ..... H01R 13/533 175/320
6,285,190 B1 * 9/2001 Brune ..... E21B 47/0232 175/45
6,360,820 B1 * 3/2002 Laborde ..... E21B 47/01 340/855.1
6,496,008 B1 * 12/2002 Brune ..... G01C 9/02 175/45
6,606,032 B1 8/2003 Fling
6,693,553 B1 * 2/2004 Ciglenec ..... E21B 47/09 340/853.3
6,727,704 B2 * 4/2004 Brune ..... E21B 47/024 175/45
6,737,867 B2 * 5/2004 Brune ..... G01V 3/15 324/326
6,739,413 B2 * 5/2004 Sharp ..... E21B 7/046 175/73
6,756,783 B2 * 6/2004 Brune ..... E21B 47/024 175/45
6,776,246 B1 * 8/2004 Nickel ..... E21B 7/046 175/45
6,801,063 B1 * 10/2004 Guo ..... H03K 17/063 327/108
6,854,535 B1 * 2/2005 Mizuno ..... E21B 47/024 175/45
6,980,123 B2 12/2005 Fling
7,025,152 B2 4/2006 Sharp
7,058,139 B2 * 6/2006 Duperray ..... H04B 1/0475 375/297
7,119,711 B2 * 10/2006 Fling ..... G01V 11/002 340/854.6
7,150,331 B2 12/2006 Cole et al.
7,158,049 B2 * 1/2007 Hoefel ..... H03B 5/1221 340/854.3
7,201,236 B1 * 4/2007 Nickel ..... E21B 47/0232 175/45
7,221,136 B2 * 5/2007 Olsson ..... G01V 3/081 324/67
7,251,567 B2 * 7/2007 Nickel ..... G01C 17/00 702/9
7,331,409 B2 * 2/2008 Cole ..... E21B 47/0232 175/45
7,624,816 B2 12/2009 Cole et al.
7,663,373 B1 * 2/2010 Gard ..... G01V 3/081 702/158
7,735,555 B2 * 6/2010 Patel ..... E21B 17/028 166/227
7,805,263 B2 9/2010 Mack
7,913,773 B2 * 3/2011 Li ..... E21B 47/12 340/854.4
8,056,619 B2 * 11/2011 Patel ..... E21B 17/028 166/242.7
8,200,292 B2 * 6/2012 Wu ..... H04W 52/0258 455/574
8,220,564 B2 7/2012 Runquist
8,270,465 B1 * 9/2012 Eliezer ..... G04R 20/10 375/238
8,407,017 B2 * 3/2013 Hancock ..... G01R 31/42 702/62
8,433,531 B2 * 4/2013 Hancock ..... G01R 31/42 702/62
8,552,856 B2 * 10/2013 McRae ..... G08C 17/00 320/132
8,567,524 B2 * 10/2013 Schimanski ..... E21B 47/13 175/45
8,612,782 B2 * 12/2013 Vilhauer ..... G06F 1/3212 713/300
8,695,727 B2 * 4/2014 Chau ..... E21B 17/042 166/65.1
8,729,901 B2 * 5/2014 Lam ..... G01V 3/15 324/333
8,768,166 B2 * 7/2014 Movassaghi ..... H04B 10/40 398/189
8,816,868 B2 * 8/2014 Tan ..... G06F 1/28 340/636.15
8,817,908 B2 * 8/2014 Lusted ..... H04L 25/4917 375/268
8,884,777 B2 * 11/2014 Kato ..... H04M 1/21 361/679.56
8,988,076 B2 * 3/2015 Mandal ..... G01R 33/3621 324/318
9,000,940 B2 * 4/2015 Chau ..... E21B 17/0285 73/152.01
9,020,523 B2 * 4/2015 Moeglein ..... G01S 19/25 455/456.1
9,065,922 B2 * 6/2015 Khan ..... H04L 67/306
9,081,098 B2 * 7/2015 Misonoo ..... G01S 15/96
9,103,198 B2 * 8/2015 Gonzalez ..... E21B 47/12
9,111,436 B2 * 8/2015 Garman ..... G08C 19/00
9,178,570 B2 * 11/2015 Deluca ..... H01M 10/48
9,194,228 B2 * 11/2015 Hall ..... E21B 43/305
9,265,560 B2 * 2/2016 Johnston ..... A61B 18/1206
9,274,243 B2 * 3/2016 Chau ..... E21B 7/30
9,369,163 B2 * 6/2016 Chen ..... H02J 50/10
9,422,802 B2 * 8/2016 Chau ..... E21B 17/0285
9,425,619 B2 * 8/2016 Chau ..... H02J 1/00
9,448,199 B2 9/2016 Roh et al.
9,581,013 B2 * 2/2017 Palmer ..... E21B 47/024
9,685,599 B2 * 6/2017 Petrovski ..... F25B 21/02
9,739,140 B2 * 8/2017 Zeller ..... G01S 11/06
9,798,033 B2 10/2017 Olsson et al.
9,836,110 B2 * 12/2017 Mickelsen ..... G06F 1/30
10,231,440 B2 * 3/2019 Seltzer ..... A01K 29/005
10,301,931 B2 * 5/2019 Derkacz ..... E21B 47/13
10,378,338 B2 * 8/2019 Zeller ..... E21B 7/046
10,385,683 B1 * 8/2019 Kaur ..... E21B 17/023
10,563,502 B1 * 2/2020 Phillips ..... E21B 47/13
10,648,326 B2 * 5/2020 Chau ..... E21B 7/046
11,118,447 B2 * 9/2021 Chau ..... E21B 7/046
11,630,231 B2 * 4/2023 Ge ..... G01V 3/28 324/339
11,668,185 B2 * 6/2023 Zhan ..... E21B 47/013 175/40
11,821,300 B1 * 11/2023 Phillips ..... E21B 47/13
11,976,555 B2 * 5/2024 Khapochkin ..... E21B 7/046
11,994,023 B2 * 5/2024 Caswell ..... E21B 47/13
12,069,590 B2 * 8/2024 Jones ..... G01R 21/06
12,270,268 B1 * 4/2025 Al-Malki ..... E21B 21/08
2002/0057074 A1 5/2002 Aoyama

(56) References Cited

U.S. PATENT DOCUMENTS

2002/0065062 A1* 5/2002 Levesque ..... H03G 3/3042 455/343.5
2002/0105331 A1* 8/2002 Brune ..... E21B 47/0232 324/326
2002/0171560 A1 11/2002 Ciglenec et al.
2003/0095608 A1 5/2003 Duperray
2004/0051627 A1* 3/2004 Parrault ..... G06K 7/0008 340/10.1
2004/0188416 A1* 9/2004 Cao ..... G03G 15/2039 219/492
2004/0189487 A1 9/2004 Hoefel et al.
2004/0215545 A1* 10/2004 Murakami ..... G06Q 40/06 705/36 R
2005/0024233 A1* 2/2005 Fling ..... G01V 11/002 340/854.6
2005/0024989 A1* 2/2005 Fling ..... G01V 11/002 367/28
2005/0248399 A1* 11/2005 Kurokawa ..... H03F 3/2171 330/10
2006/0012490 A1* 1/2006 Fling ..... G01V 3/081 340/853.3
2006/0122473 A1 6/2006 Kill
2007/0126123 A1* 6/2007 Sawachi ..... H05K 3/4691 257/777
2007/0149162 A1* 6/2007 Greene ..... H03F 3/24 455/343.1
2008/0238622 A1* 10/2008 Rofougaran ..... H04B 5/22 375/371
2008/0252449 A1* 10/2008 Colvero ..... G01C 15/04 340/540
2008/0311961 A1 12/2008 Cotevino
2009/0245025 A1 10/2009 Rhodes
2009/0264789 A1* 10/2009 Molnar ..... A61N 1/36135 600/595
2010/0090530 A1 4/2010 Watanabe
2010/0214082 A1* 8/2010 Covaro ..... H03K 7/08 370/212
2010/0216521 A1 8/2010 Wu
2010/0244958 A1* 9/2010 Tsuji ..... H03F 3/2173 330/251
2010/0253291 A1 10/2010 Lin
2010/0270979 A1 10/2010 Bonkhoff
2010/0308744 A1* 12/2010 Yang ..... H05B 45/10 315/307
2011/0001633 A1 1/2011 Lam et al.
2011/0018735 A1* 1/2011 Garcia-Osuna ..... G01V 11/002 340/854.4
2011/0089162 A1* 4/2011 Graber ..... H05B 6/062 219/620
2011/0170590 A1* 7/2011 Ghabra ..... H03G 1/0052 340/13.25
2011/0192835 A1* 8/2011 Lee ..... H05B 6/12 219/621
2011/0208456 A1 8/2011 Mickelsen
2011/0316715 A1 12/2011 Kato et al.
2012/0046030 A1* 2/2012 Siomina ..... H04W 24/02 455/423
2012/0109552 A1 5/2012 Hancock et al.
2012/0109553 A1 5/2012 Hancock et al.
2012/0115488 A1* 5/2012 Jiang ..... H04W 52/325 455/438
2012/0146538 A1* 6/2012 Nerone ..... H05B 45/385 315/291
2012/0169270 A1 7/2012 Cho et al.
2012/0206269 A1* 8/2012 Wickman ..... H05B 47/115 324/679
2012/0211278 A1 8/2012 Gonzalez et al.
2012/0217971 A1 8/2012 Deluca
2012/0218863 A1* 8/2012 Chau ..... E21B 47/12 367/82
2012/0249323 A1 10/2012 McRae
2012/0254633 A1 10/2012 Vilhauer et al.
2012/0263460 A1* 10/2012 Movassaghi ..... H04B 10/40 398/38
2012/0287985 A1* 11/2012 Okamura ..... H04L 25/02 375/300
2012/0288019 A1* 11/2012 Okamura ..... H02J 50/80 375/259
2012/0306655 A1 12/2012 Tan
2012/0323511 A1 12/2012 Saigo et al.
2013/0015795 A1* 1/2013 Lee ..... H02P 6/06 318/400.13
2013/0017840 A1 1/2013 Moeglein et al.
2013/0028300 A1* 1/2013 Alberth ..... H04B 1/1607 375/219
2013/0033233 A1 2/2013 Noda et al.
2013/0093567 A1 4/2013 Garman et al.
2013/0154635 A1 6/2013 Mandal
2013/0162402 A1 6/2013 Amann
2013/0162404 A1* 6/2013 Striemer ..... G01D 9/007 235/492
2013/0176137 A1 7/2013 Kolpack et al.
2013/0176139 A1* 7/2013 Chau ..... E21B 7/046 340/854.4
2013/0200901 A1 8/2013 Olsson et al.
2013/0214599 A1* 8/2013 Taira ..... G06F 1/04 307/31
2013/0272449 A1* 10/2013 Lusted ..... H04L 25/4917 375/295
2013/0293018 A1 11/2013 Wu et al.
2013/0342178 A1* 12/2013 Wang ..... G05F 1/66 323/234
2014/0022088 A1* 1/2014 Chau ..... E21B 47/10 340/854.1
2014/0055278 A1 2/2014 Chau et al.
2014/0225622 A1 8/2014 Kudo
2014/0232201 A1* 8/2014 Staring ..... H01F 38/14 307/104
2014/0252866 A1* 9/2014 Walsh ..... H04W 4/80 307/104
2014/0262513 A1 9/2014 Chau et al.
2014/0265619 A1* 9/2014 Chau ..... E21B 47/13 307/104
2014/0266018 A1* 9/2014 Carobolante ..... H02J 50/60 320/108
2014/0266770 A1 9/2014 Chau et al.
2014/0273885 A1 9/2014 Chen
2014/0286219 A1* 9/2014 Siomina ..... H04W 24/10 370/311
2015/0022147 A1* 1/2015 Jung ..... H02J 50/80 320/108
2015/0070186 A1 3/2015 Gonzalez et al.
2015/0072721 A1* 3/2015 Lagnado ..... H04W 52/28 455/522
2015/0167425 A1* 6/2015 Hammer ..... E21B 47/16 166/250.01
2016/0069180 A1 3/2016 Zeller et al.
2019/0003299 A1 1/2019 Zeller et al.
2019/0211670 A1 7/2019 Chau et al.
2020/0232317 A1 7/2020 Chau et al.

OTHER PUBLICATIONS

Raghavan et al., Architectural Comparison of Analog and Digital Duty Cycle Corrector for High Speed IO Link (Year: 2010).*
Written Opinion of the International Preliminary Examining Authority for International Application No. PCT/2014/030605 which is associated with U.S. Appl. No. 14/214,074, May 18, 2015, Alexandria, VA.
International Preliminary Report on Patentability for International Application No. PCT/2014/030605 which is associated with U.S. Appl. No. 14/214,074, Sep. 16, 2015, Alexandria, VA.
The International Search Report and The Written Opinion of the International Searching Authority for International Application No. PCT/2014/030605 which is associated with U.S. Appl. No. 14/214,074, Jul. 10, 2014, Moscow, Russia.
Prosecution History of U.S. Appl. No. 14/214,074, filed Mar. 14, 2014, as of Mar. 7, 2019.

(56) References Cited

OTHER PUBLICATIONS

Prosecution History of U.S. Appl. No. 15/231,782, filed Aug. 9, 2016, as of Mar. 7, 2019.
International Search Report and Written Opinion in PCT Application No. PCT/US2022/034336 which is related to U.S. Appl. No. 17/843,838, dated Oct. 12, 2022.
Chapter II Demand Relating to the International Search Report and Written Opinion in PCT Application No. PCT/US2022/034336 which is related to U.S. Appl. No. 17/843,838, dated Apr. 21, 2023.
Office Action in U.S. Appl. No. 17/843,838, dated Jun. 7, 2023, Alexandria, VA.

* cited by examiner 604 608 612 600

| Row | Duty Cycle % off / % on | Waveform |
|---|---|---|
| 1 | 20/80 |  |
| 2 | 30/70 |  |
| 3 | 40/60 |  |
| 4 | 50/50 |  |
| 5 | 60/40 |  |
| 6 | 70/30 |  |
| 7 | 80/20 |  |

INGROUND DEVICE WITH ADVANCED TRANSMIT POWER CONTROL AND ASSOCIATED METHODS

RELATED APPLICATIONS

The present application is a continuation of co-pending U.S. application Ser. No. 16/297,634, filed on Mar. 9, 2019; which is a continuation of U.S. application Ser. No. 14/213,644, filed on Mar. 14, 2014 and issued as U.S. Pat. No. 10,240,456 on Mar. 26, 2019; which claims priority from U.S. Provisional Patent Application Ser. No. 61/798,139, filed on Mar. 15, 2013, each of which is hereby incorporated by reference in their entirety.

BACKGROUND

The present invention is generally related to the field of communications relating to an inground device and, more particularly, to an inground device with advanced transmit power control and associated methods.

While not intended as being limiting, one example of an application which involves the use of an inground device or transmitter is Horizontal Directional Drilling (HDD). The latter can be used for purposes of installing a utility without the need to dig a trench. A typical utility installation involves the use of a drill rig having a drill string that supports a boring tool, serving as one embodiment of an inground tool, at a distal or inground end of the drill string. The transmitter is generally carried by the boring tool. The drill rig forces the boring tool through the ground by applying a thrust force to the drill string. The boring tool is steered during the extension of the drill string to form a pilot bore. Upon completion of the pilot bore, the distal end of the drill string is attached to a pullback apparatus which is, in turn, attached to a leading end of the utility. The pullback apparatus and utility are then pulled through the pilot bore via retraction of the drill string to complete the installation. In some cases, the pullback apparatus can comprise a back reaming tool, serving as another embodiment of an inground tool, which expands the diameter of the pilot bore ahead of the utility so that the installed utility can be of a greater diameter than the original diameter of the pilot bore.

Steering of a boring tool can be accomplished in a well-known manner by orienting an asymmetric face of the boring tool for deflection in a desired direction in the ground responsive to forward movement. In order to control this steering, it is desirable to monitor the orientation of the boring tool based on sensor readings obtained by sensors that form part of the transmitter carried by the boring tool or other inground tool. The sensor readings, for example, can be modulated onto a locating signal that is transmitted by the transmitter for reception above ground by a portable locator or other suitable above ground device. In some systems, the transmitter can couple a carrier signal modulated by the sensor readings onto the drill string to then transmit the signal to the drill rig by using the drill string as an electrical conductor. One class of prior art transmitters is battery powered. It should be appreciated that an inground operation is generally adversely affected by draining the batteries to a degree that renders the transmitter as inoperable, resulting in the need to enter a time consuming process to trip the transmitter out of the ground simply to replace the batteries. The prior art has adopted a number of different approaches in order to attempt to address concerns relating to transmitter battery life. One approach resides in the use of higher capacity batteries. While higher capacity batteries are generally higher in cost, a greater limitation may reside in the higher capacity battery having a physical outline and/or characteristic voltage that is incompatible for installation in a given transmitter. Another approach taken by the prior art resides in reducing transmitter power consumption in order to extend battery life. Of course, this approach reduces transmitter output power and invokes the competing interest of limiting transmission range, which can be of limited value when the inground operation is being performed at relatively high depths and/or range. Still other approaches are described hereinafter, however, each of these approaches is recognized as introducing associated limitations.

The foregoing examples of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In one aspect of the disclosure, an apparatus and associated method are described for use with a system for performing an inground operation having the apparatus supported at least proximate to the inground tool during the inground operation. A housing is configured, as part of the apparatus, for receiving a battery having one of at least two different battery voltages. A transmitter is supported within the housing for receiving electrical power from the battery and configured for (i) transmitting at least one signal from the apparatus using at least two different transmit power levels for at least one of locating the transmitter and characterizing an orientation of the transmitter, (ii) detecting the battery voltage, and (iii) selecting one of the transmit power levels based on the detected battery voltage.

In another aspect of the disclosure, an apparatus and associated method are described for use with a system for performing an inground operation in which a drill string extends from a drill rig to an inground tool with the apparatus supported at least proximate to the inground tool during the inground operation. The apparatus includes a transmitter configured for transmitting at least one signal from the transmitter using one of at least two different transmit power levels at least by utilizing a duty cycle of the signal that is different for each different transmit power level.

BRIEF DESCRIPTIONS OF THE DRAWINGS

Example embodiments are illustrated in referenced figures of the drawings. It is intended that the embodiments and figures disclosed herein are to be illustrative rather than limiting.

DETAILED DESCRIPTION

The following description is presented to enable one of ordinary skill in the art to make and use the invention and is provided in the context of a patent application and its requirements. Various modifications to the described embodiments will be readily apparent to those skilled in the art and the generic principles taught herein may be applied to other embodiments. Thus, the present invention is not intended to be limited to the embodiments shown, but is to be accorded the widest scope consistent with the principles and features described herein including modifications and equivalents. It is noted that the drawings are not to scale and are diagrammatic in nature in a way that is thought to best illustrate features of interest. Descriptive terminology may be adopted for purposes of enhancing the reader's understanding, with respect to the various views provided in the figures, and is in no way intended as being limiting.

Figure 1:
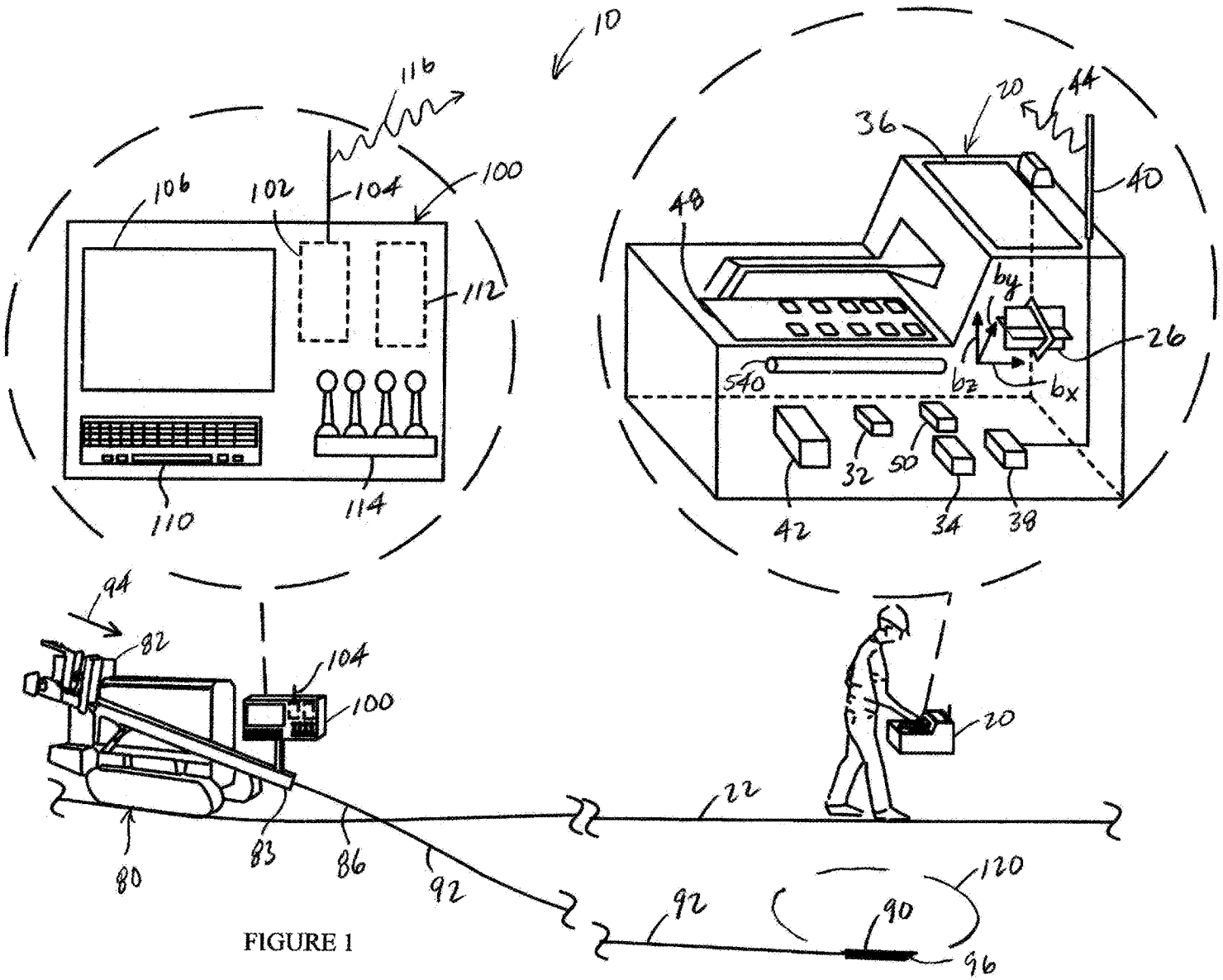
FIG. 1 is a diagrammatic view, in elevation, of an embodiment of a system for performing an inground operation which utilizes an inground device with advanced transmit power control in accordance with the present disclosure.

Turning now to the drawings, wherein like items may be indicated by like reference numbers throughout the various figures, attention is immediately directed to FIG. 1, which illustrates one embodiment of a system for performing an inground operation, generally indicated by the reference number 10. The system includes a portable device 20 that is shown being held by an operator above a surface 22 of the ground as well as in a further enlarged inset view. It is noted that inter-component cabling within device 20 has not been illustrated in order to maintain illustrative clarity, but is understood to be present and may readily be implemented by one having ordinary skill in the art in view of this overall disclosure. Device 20 includes a three-axis antenna cluster 26 measuring three orthogonally arranged components of magnetic flux indicated as $b_x$, $b_y$ and $b_z$. One useful antenna cluster contemplated for use herein is disclosed by U.S. Pat. No. 6,005,532 which is commonly owned with the present application and is incorporated herein by reference. Antenna cluster 26 is electrically connected to a receiver section 32. A tilt sensor arrangement 34 may be provided for measuring gravitational angles from which the components of flux in a level coordinate system may be determined.

Device 20 can further include a graphics display 36, a telemetry arrangement 38 having an antenna 40 and a processing section 42 interconnected appropriately with the various components. The telemetry arrangement can transmit a telemetry signal 44 for reception at the drill rig. The processing section can include a digital signal processor (DSP) or any suitable processor that is configured to execute various procedures that are needed during operation. It should be appreciated that graphics display 36 can be a touch screen in order to facilitate operator selection of various buttons that are defined on the screen and/or scrolling can be facilitated between various buttons that are defined on the screen to provide for operator selection. Such a touch screen can be used alone or in combination with an input device 48 such as, for example, a keypad. The latter can be used without the need for a touch screen. Moreover, many variations of the input device may be employed and can use scroll wheels and other suitable well-known forms of selection device. The processing section can include components such as, for example, one or more processors, memory of any appropriate type and analog to digital converters. As is well known in the art, the latter should be capable of detecting a frequency that is at least twice the frequency of the highest frequency of interest. Other components may be added as desired such as, for example, a magnetometer 50 to aid in position determination relative to the drill direction and ultrasonic transducers for measuring the height of the device above the surface of the ground.

Still referring to FIG. 1, system 10 further includes drill rig 80 having a carriage 82 received for movement along the length of an opposing pair of rails 83. An inground tool 90 is attached at an opposing end of a drill string 92. By way of non-limiting example, a boring tool is shown as the inground tool and is used as a framework for the present descriptions, however, it is to be understood that any suitable inground device may be used such as, for example, a reaming tool for use during a pullback operation or a mapping tool. Generally, drill string 92 is made up of a plurality of removably attachable drill pipe sections such that the drill rig can force the drill string into the ground using movement in the direction of an arrow 94 and retract the drill string responsive to an opposite movement. The drill pipe sections can define a through passage for purposes of carrying a drilling mud or fluid that is emitted from the boring tool under pressure to assist in cutting through the ground as well as cooling the drill head. Generally, the drilling mud also serves to suspend and carry out cuttings to the surface along the exterior length of the drill string. Steering can be accomplished in a well-known manner by orienting an asymmetric face 96 of the boring tool for deflection in a desired direction in the ground responsive to forward, push movement which can be referred to as a "push mode." Rotation or spinning of the drill string by the drill rig will generally result in forward or straight advance of the boring tool which can be referred to as a "spin" or "advance" mode.

The drilling operation is controlled by an operator (not shown) at a control console 100 (best seen in the enlarged inset view) which itself includes a telemetry transceiver 102 connected with a telemetry antenna 104, a display screen 106, an input device such as a keyboard 110, a processing arrangement 112 which can include suitable interfaces and memory as well as one or more processors. A plurality of control levers 114, for example, control movement of carriage 82. Telemetry transceiver 102 can transmit a telemetry signal 116 to facilitate bidirectional communication with portable device 20. In an embodiment, screen 106 can be a touch screen such that keyboard 110 may be optional.

Device 20 is configured for receiving an electromagnetic locating signal 120 that is transmitted from the boring tool or other inground tool. The locating signal can be a dipole signal. In this instance, the portable device can correspond, for example, to the portable device described in any of U.S. Pat. Nos. 6,496,008, 6,737,867, 6,727,704, as well as U.S. Published Patent Application no. 2011-0001633 each of which is incorporated herein by reference. In view of these patents, it will be appreciated that the portable device can be operated in either a walkover locating mode, as illustrated by FIG. 1, or in a homing mode having the portable device placed on the ground, as illustrated by the U.S. Pat. No.

6,727,704 Patent. While the present disclosure illustrates a dipole locating field transmitted from the boring tool and rotated about the axis of symmetry of the field, the present disclosure is not intended as being limiting in that regard.

Locating signal 120 can be modulated with information generated in the boring tool including, but not limited to position orientation parameters based on pitch and roll orientation sensor readings, temperature values, pressure values, battery status, tension readings in the context of a pullback operation, and the like. Device 20 receives signal 120 using antenna array 26 and processes the received signal to recover the data. It is noted that, as an alternative to modulating the locating signal, the subject information can be carried up the drill string to the drill rig using electrical conduction such as a wire-in-pipe arrangement. In another embodiment, bi-directional data transmission can be accomplished by using the drill string itself as an electrical conductor. An advanced embodiment of such a system is described in commonly owned U.S. application Ser. No. 13/733,097, now published as U.S. Published Patent Application no. 2013/0176139, which is incorporated herein by reference in its entirety. In either case, all information can be made available to a console 100 at the drill rig.

Figure 2:
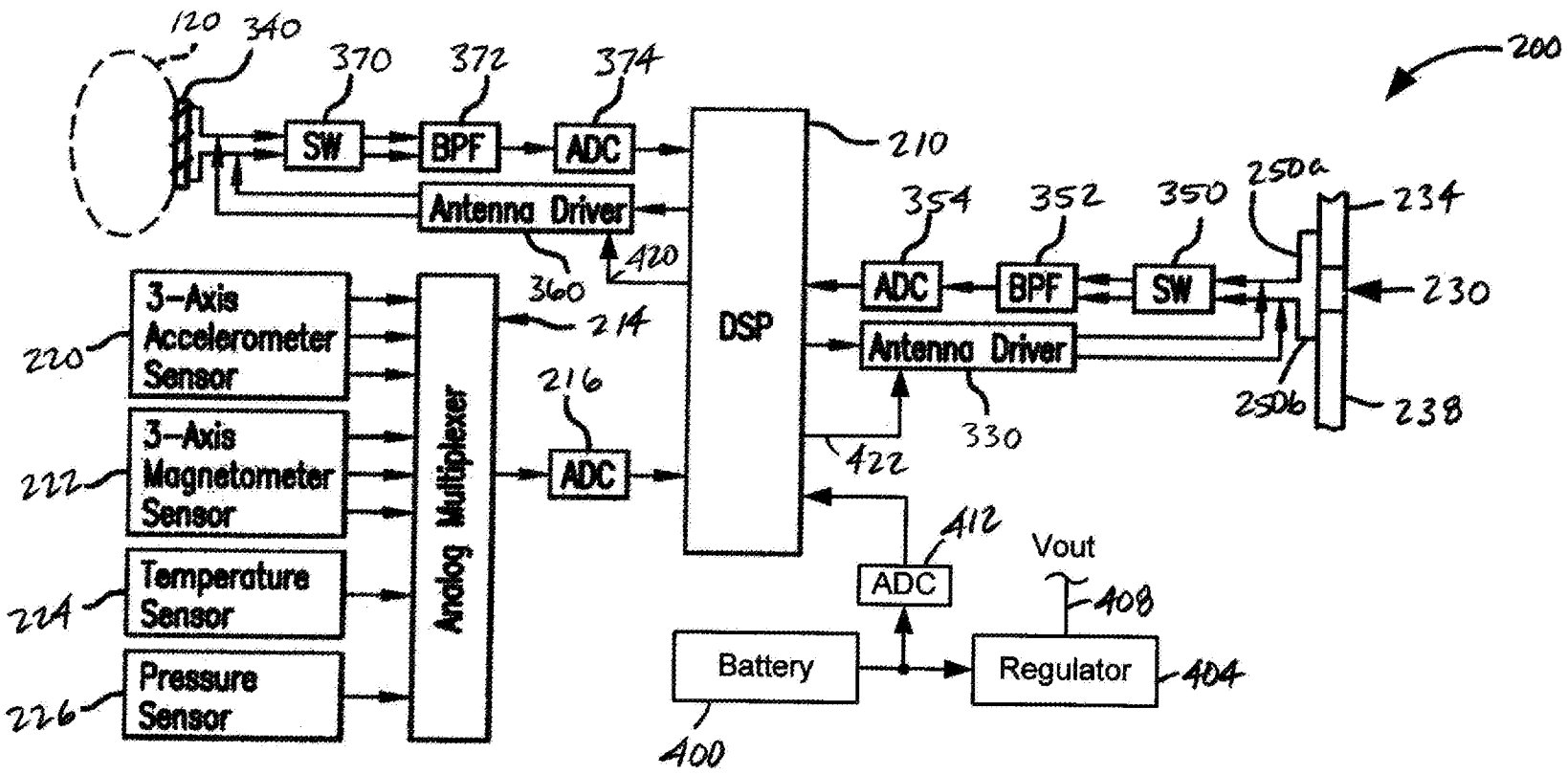
FIG. 2 is a block diagram that illustrates an embodiment of an electronics package for use in an inground device or tool in accordance with the present disclosure.

FIG. 2 is a block diagram which illustrates an embodiment of an electronics package, generally indicated by the reference number 200, which can be supported by boring tool 90. The electronics package can include an inground digital signal processor 210. A sensor section 214 can be electrically connected to digital signal processor 210 via an analog to digital converter (ADC) 216. Any suitable combination of sensors can be provided for a given application and can be selected, for example, from an accelerometer 220, a magnetometer 222, a temperature sensor 224 and a pressure sensor 226 which can sense the pressure of drilling fluid prior to being emitted from the drill string and/or within the annular region surrounding the downhole portion of the drill string. In an embodiment which implements communication to the drill rig via the use of the drill string as an electrical conductor, an isolator 230 forms an electrically isolating connection in the drill string and is diagrammatically shown as separating an uphole portion 234 of the drill string from a downhole portion 238 of the drill string for use in one or both of a transmit mode, in which data is coupled onto the drill string, and a receive mode in which data is recovered from the drill string. In some embodiments, the electrical isolation can be provided as part of the inground tool. The electronics section can be connected, as illustrated, across the electrically insulating/isolating break formed by the isolator by a first lead 250*a* and a second lead 250*b* which can be referred to collectively by the reference number 250. For the transmit mode, an isolator driver section 330 is used which is electrically connected between inground digital signal processor 210 and leads 250 to directly drive the drill string. Generally, the data that can be coupled into the drill string can be modulated using a frequency that is different from any frequency that is used to drive a dipole antenna 340 that can emit aforedescribed signal 120 (FIG. 1) in order to avoid interference. When isolator driver 330 is off, an On/Off Switcher (SW) 350 can selectively connect leads 250 to a band pass filter (BPF) 352 having a center frequency that corresponds to the center frequency of the data signal that is received from the drill string. BPF 352 is, in turn, connected to an analog to digital converter (ADC) 354 which is itself connected to digital signal processing section 210. In an embodiment, a DC blocking anti-aliasing filter can be used in place of a band pass filter. Recovery of the modulated data in the digital signal processing section can be readily configured by one having ordinary skill in the art in view of the particular form of modulation that is employed.

Still referring to FIG. 2, dipole antenna 340 can be connected for use in one or both of a transmit mode, in which signal 120 is transmitted into the surrounding earth, and a receive mode in which an electromagnetic signal such as a signal from an inground tool such as, for example, a tension monitor is received. For the transmit mode, an antenna driver section 360 is used which is electrically connected between inground digital signal processor 210 and dipole antenna 340 to drive the antenna. Again, the frequency of signal 120 will generally be sufficiently different from the frequency of the drill string signal to avoid interference therebetween. When antenna driver 360 is off, an On/Off Switcher (SW) 370 can selectively connect dipole antenna 340 to a band pass filter (BPF) 372 having a center frequency that corresponds to the center frequency of the data signal that is received from the dipole antenna. In an embodiment, a DC blocking anti-aliasing filter can be used in place of a band pass filter. BPF 372 is, in turn, connected to an analog to digital converter (ADC) 374 which is itself connected to digital signal processing section 210. Transceiver electronics for the digital signal processing section can be readily configured in many suitable embodiments by one having ordinary skill in the art in view of the particular form or forms of modulation employed and in view of this overall disclosure. A battery 400 provides electrical power to a voltage regulator 404. A voltage output, $V_{out}$, 408 can include one or more output voltage values as needed by the various components of the electronics package. The output voltage of battery 400 can be monitored, for example, by DSP 210 using an analog to digital converter 412. Control lines 420 and 422 from the DSP to drivers 360 and 330, respectively, can be used, for example, to customize locating signal 120 transmit power and/or drill string transmit power that is provided to isolator 230. The transmit power can be modified, for example, by changing the gain at which antenna driver 360 amplifies the signal that is provided from the DSP. The electronics package can be modified in any suitable manner in view of the teachings that have been brought to light herein. For example, in another embodiment, transmit power can be modified in another manner either in conjunction with gain control or independently, as will be described. In this regard, any suitable number of different gain values can be utilized and is not limited to two.

Referring again to FIG. 1, the depth range at which locating signal 120 can be received by portable device 20 is influenced by factors which include the transmission power of the locating signal as well as local interference. The latter can be experienced in passive and/or active forms. Active interference can be considered as any source that emits a signal or generates its own magnetic field. Some examples of active interference include power lines, traffic loops, fiber trace lines and invisible dog fences. Passive interference can be considered as anything that blocks, absorbs or distorts a magnetic field. Examples include metal structures, such as chain link fences, rebar and salt water. Anything that is electrically conductive has the potential to impose passive interference. In state-of-the-art equipment, interference can be at least partially avoided through the selection of transmission frequency. That is, through the identification and selection of the best (i.e., lowest noise) transmitting frequency with respect to the particular interference at hand. In some cases, however, Applicants recognize that there may not be a suitable transmitting frequency available that entirely satisfies locating system operational needs with respect to interference that is encountered at a given job site. Moreover, the adverse influence of interference can be further enhanced when relatively greater depth range is needed for a particular inground operation. In instances of high interference and/or the need for increased depth range, the prior art has generally been limited to one of two different approaches:

1) The use of a wireline or wire-in-pipe system, which requires forming an isolated wire connection through the inside length of the drill string. Electrical power can be transmitted to the inground electronics package via the wireline such that the downhole electronics package can utilize a relatively high transmission power to compensate for adverse interference and/or depth range requirements, thereby avoiding the limitations that would otherwise be imposed by limited battery power in the downhole electronics package; and
2) The use of a high-power transmitter in the inground electronics package to increase transmission power to a fixed value that is beyond the capability of what would be considered as a standard battery-powered transmitter. Thus, transmission power is increased in view of adverse interference and/or depth range requirements. That is, the signal-to-noise ratio is increased for a given depth range.

Concerns are recognized by Applicants with respect to both of these approaches. With respect to a wireline, the added time to complete a wire connection for each drill pipe section can significantly slow down the drilling process, which increases cost. Moreover, the use of a wireline system is not flexible to the needs of tripping out to replace a worn drill bit, requiring an even further commitment of time and effort to maintaining the wireline. Based on such concerns, a wireline can be characterized by a risk profile that is often too high for a particular end user to consider as a viable option. Using a high-power transmitter, on the other hand, often requires a longer drill housing at the inground tool to carry to a longer transmitter (for example, 15" vs. 19"). The cost of the high power transmitter as well as the longer drill housing both contribute to added costs for the end user. Further, battery life is a concern with respect to a high-power transmitter. Battery life can be considered in this context as the operating time of a transmitter. It should be appreciated that a longer operating time is beneficial to the end user in terms of reducing the number of times the transmitter is required to be removed from the bore to replace the batteries. When a high power transmitter is purchased, it is generally suggested that lithium batteries should be used exclusively, due to the high power requirements of the transmitter which significantly increases cost over the lifetime of the high power transmitter. If not, the operating time can be greatly reduced to an unacceptable degree. Another concern resides in the inflexibility of the high-power transmitter to operate at standard power levels under appropriate operational conditions which do not require high power.

Applicants bring to light hereinafter a number of embodiments for managing transmitter power output in highly flexible ways that provide benefits that are submitted to be heretofore unknown. These embodiments achieve highly flexible transmitter power control relating at least to battery considerations, drive signal modulation considerations, and other modes of remote communication, as will be seen and described in relation to the various figures. Reference is further made to U.S. patent application Ser. No. 13/734,841, now published as U.S. Published Patent Application no. 2013-0176137, entitled HORIZONTAL DIRECTIONAL DRILLING AREA NETWORK AND METHODS which is hereby incorporated by reference in its entirety and which describes various modes of such communication.

Referring to FIG. 2, an embodiment of inground electronics package 90 is configured in view of Applicants' recognitions in a heretofore unseen manner. In particular, the present embodiment of inground electronics package 90 includes what can be referred to as having a "boost mode", whereby the transmitter output power for locating signal 120 and/or a drill string communication signal is customized based on the type of battery or batteries 400 that are installed. For example, a selection between at least two different transmitter power levels for either of these signals can be made. These power levels can be referred to, by way of non-limiting example, as standard power and high power (or boost power), although any suitable terminology can be used. The remaining discussions are primarily framed in terms of locating signal 120 and antenna driver 360 for purposes of brevity, but should be understood to have equal applicability with respect to the drill string signal that is coupled onto the drill string by isolator 230 as driven by isolator driver 330.

Table 1 characterizes a dual-mode transmitter that is configured in accordance with the present disclosure based on battery voltage. There are different battery configurations that can be used to power the transmitter such as, by way of non-limiting example:

TABLE 1

Multimode Transmitter Power

| Configuration no. | Battery Type | Voltage | Power Level |
|---|---|---|---|
| 1 | Alkaline c-cell (2 in series) | 3.0 VDC @ 1.5 VDC per cell | Standard |
| 2 | Lithium Supercell | 3.6 VDC 1 cell | Standard |
| 3 | Lithium C cell (2 in series) | 7.2 VDC @ 3.6 VDC per cell | High |

Configurations 1 and 2 in Table 1 represent configurations in accordance with the present disclosure that utilize the standard power mode for antenna driver 360 of FIG. 2. However, if the input voltage is greater than a threshold such as, for example, 4.58 volts, DSP 210 via ADC 412 detects that the threshold has been exceeded and the DSP configures the antenna driver to output more power. Of course, any suitable threshold or thresholds can be established based on battery cell voltages and cell combinations for battery types that are either currently available or yet to be developed. The additional power for the boost mode can, by way of non-limiting example, represent an increase of 10 percent. As another example, the power increase can be in the range of 5 percent to 20 percent. In still another example, a set of three or more power levels can be defined including a stepwise increase in power from one level to the next. The step value can be any suitable amount and is not required to be equal from level to level. In some embodiments, the change in signal strength/power can be configured on-the-fly, for example, based on communication signals from the drill rig that are transferred down the drill string. In the instance of configuration 3 of Table 1, the use of 2 lithium c-cells (for example, SAFT LSH14) can provide an available battery voltage of 7.2 volts DC, thereby satisfying the voltage threshold required for entering the boost or high power mode.

Figure 3:
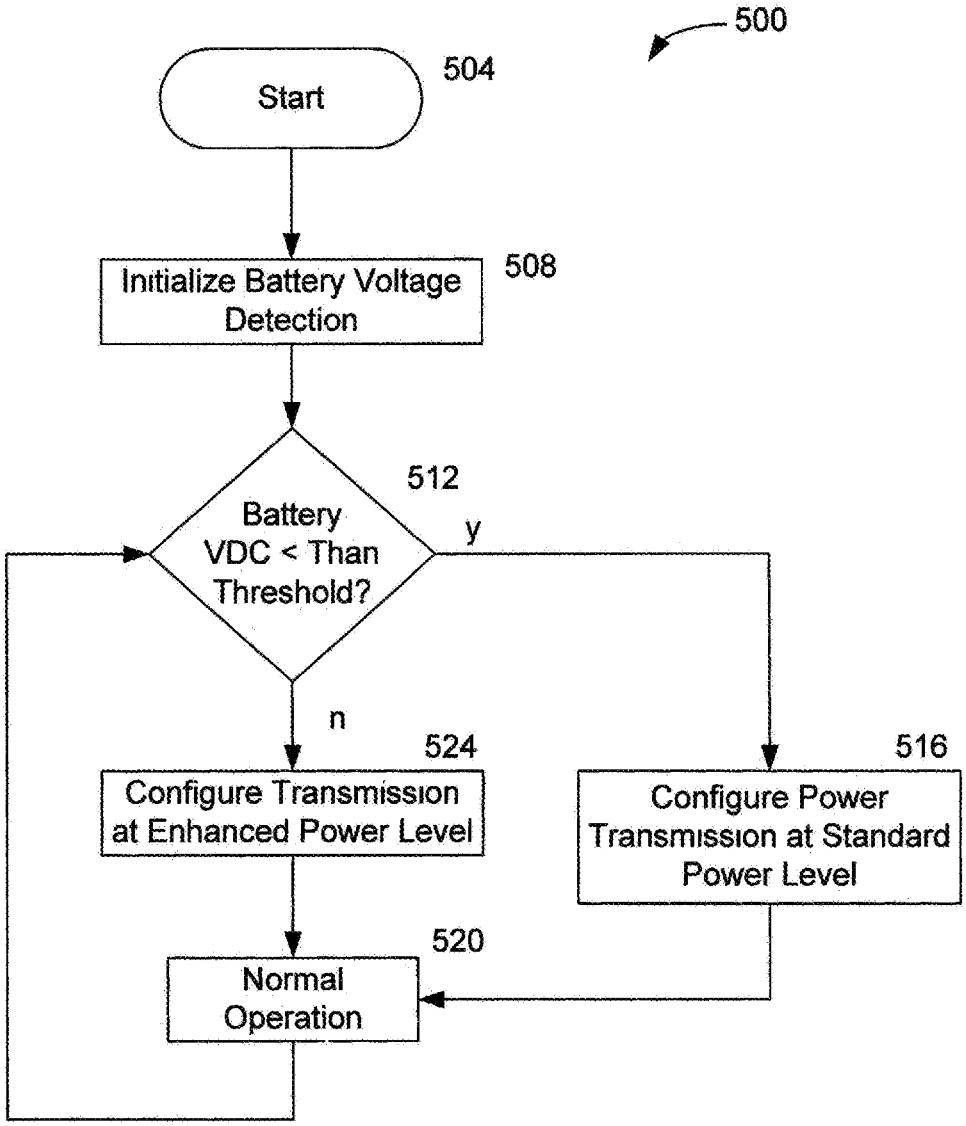
FIG. 3 is a flow diagram illustrating an embodiment of a method for transmitter power mode selection in accordance with the present disclosure.

Attention is now directed to FIG. 3 which is a flow diagram illustrating one embodiment of a method for transmitter power mode selection, generally indicated by the reference number 500, in accordance with the present disclosure. The method begins at start 504 which can be initiated responsive to the installation of batteries in electronics package 200 of FIG. 2. The method then proceeds to 508 for detecting the battery voltage of the particular battery or batteries that have been installed. At 512, the detected voltage is compared to one or more thresholds for purposes of establishing the transmission power to be specified. When a standard power mode and an enhanced or boost power mode are available, a single threshold is involved such that operation branches to 516 when the detected voltage is less than the threshold. In this case, at 516, antenna driver 360 and/or isolator driver 330 can be configured to operate at a standard power transmission level. Normal operation is then entered at 520. On the other hand, if the detected voltage at 512 exceeds the threshold, operation branches to 524 which can configure antenna driver 360 and/or isolator driver 330 to operate at an enhanced or boost power transmission level. Subsequently, normal operation is entered at 520.

Referring to FIGS. 1 and 3, during normal operation 520, transmission powers can be changed, for example, responsive to communication from an aboveground component such as the drill rig and/or portable device. In this way, power selection at any suitable resolution can be performed. In an embodiment, the wireless communication can be established from a dipole antenna 540 in portable device 20 to antenna 340 of the inground electronics package. In another embodiment, antenna 26 can be used for such communication. Any suitable and currently available form of wireless communication is acceptable such as, for example, ZigBee or Bluetooth, as well as other types yet to be developed, with suitable provisions being made for antennas above ground and below.

In an embodiment, transmission power control can be achieved by adjusting the duty cycle of modulation, for example, of locating signal 120 transmitted from the inground electronics package. As described above, the locating signal can be modulated with data that is obtained from a sensor suite. The control of the duty cycle, for example, in 5% increments can provide many different power levels and respective battery performance configurations based on the needs of the drill site environment. In this regard, any suitable power increment or change in step value can be provided. In some embodiments, power levels can be established through changing gain levels in combination with duty cycle control. Accordingly, a multimode transmitter can be configured to switch between a first power control mode based on gain level control and a second power control mode based on duty cycle control. In another embodiment, the transmitter can be configured to operate in yet a third power control mode that is a combination of gain level control and duty cycle control.

Figure 4:
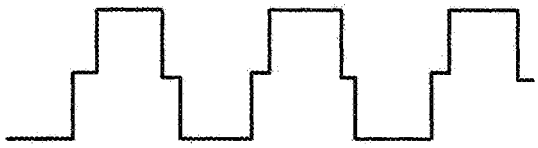
FIG. 4 is a table which illustrates the appearance of embodiments of drive waveforms for purposes of driving the drill string and/or an antenna, for example, using the electronics package of FIG. 2.
Figure 4:
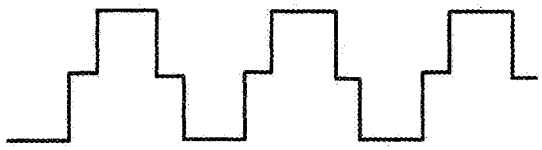
Figure 4:
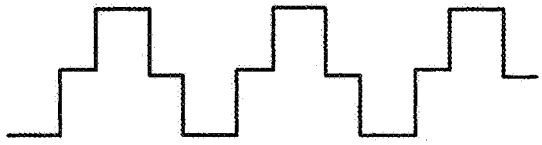
Figure 4:
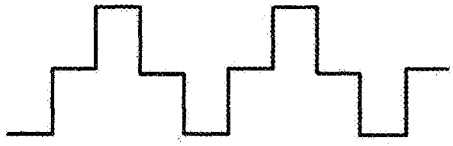
Figure 4:
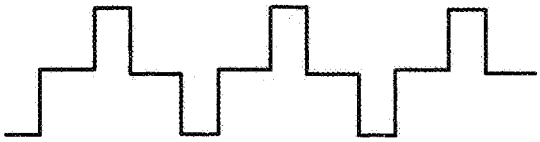
Figure 4:
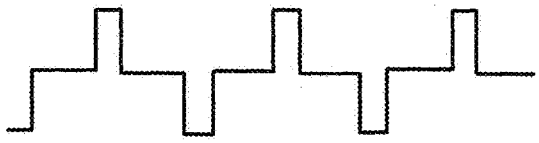
Figure 4:
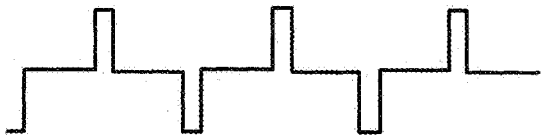

FIG. 4 is a table, generally indicated by the reference number 600, which illustrates the appearance of a series of drive waveforms for purposes of driving an antenna at different power levels based on changing the duty cycle of the modulation. Of course, such drive waveforms can be used for driving the drill string, as described herein. A first column 604 indicates a row number. A second column 608 indicates the duty cycle as the percentage of off time versus the percentage on time and a third column 612 illustrates a waveform for each of seven rows. Row 1 illustrates a waveform at a duty cycle of 20 percent off time and 80 percent on time, which represents the highest output power that is shown. Row 7 illustrates a waveform at a duty cycle of 80 percent off time and 20 percent on time which represents the lowest output power that is shown. Rows 2-6 are distributed at 10 percent increments between rows 1 and 7. These increments are provided by way of non-limiting example. In embodiments, any suitable distribution in terms of number and incremental change can be provided. Further, the increment from row to row is not required to be equal. In an embodiment, the percent duty cycle change can be customized to provide a desired change in transmit power level from row to row such as, for example, an equal transmit power change. While using duty cycle power transmit control, in and by itself, provides a remarkable degree of control over transmit power, this control can be used in conjunction with gain control to provide even further flexibility.

Figure 5:
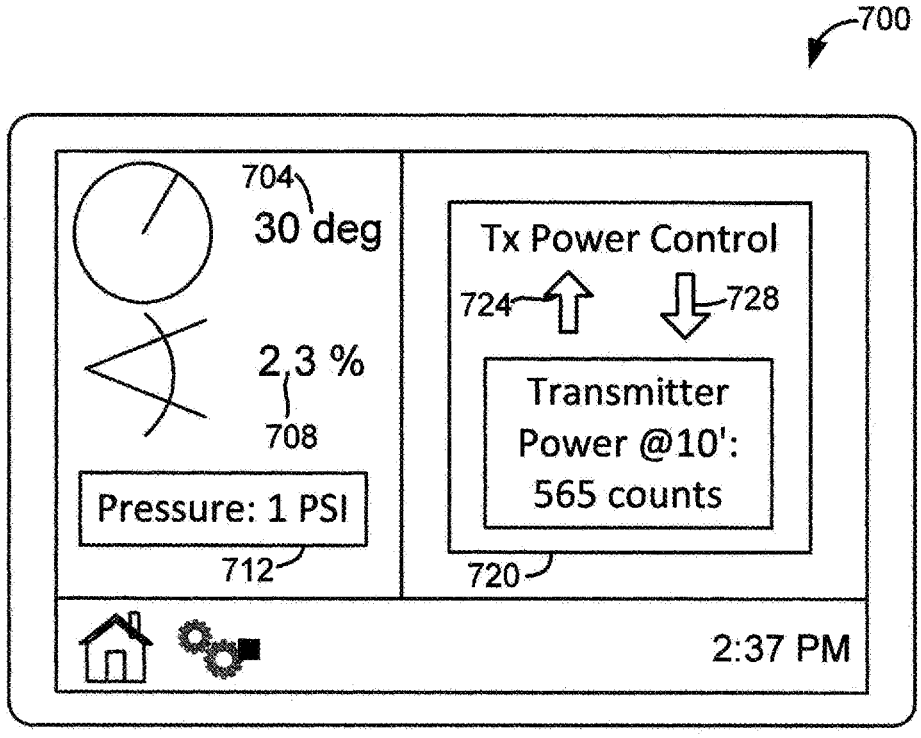
FIG. 5 illustrates an embodiment of a screen shot for above ground display which provides selections for controlling transmit power of an inground transmitter as well as displaying the currently detected transmitter power.

Attention is now directed to FIG. 5 which illustrates one embodiment of a screen shot that is generally indicated by the reference number 700 and can be presented, for example, on display 36 (FIG. 1) of the portable device and/or on display 106 at the drill rig. The display is a touchscreen display for purposes of the present example although this is not required. The screen shot displays orientation information for the inground tool including roll orientation 704 and pitch orientation 708. Sensed pressure, for example, from pressure sensor 226 of FIG. 2 is provided at 712. In accordance with the present disclosure, the currently detected transmitter power is indicated at 720 and can be changed by selecting an up arrow 724 and a down arrow 728. When transmit power is at an upper or lower limit, the appropriate arrow can be grayed out. Transmit power changes can be implemented, for example, using duty cycle control, as described above.

Figure 6:
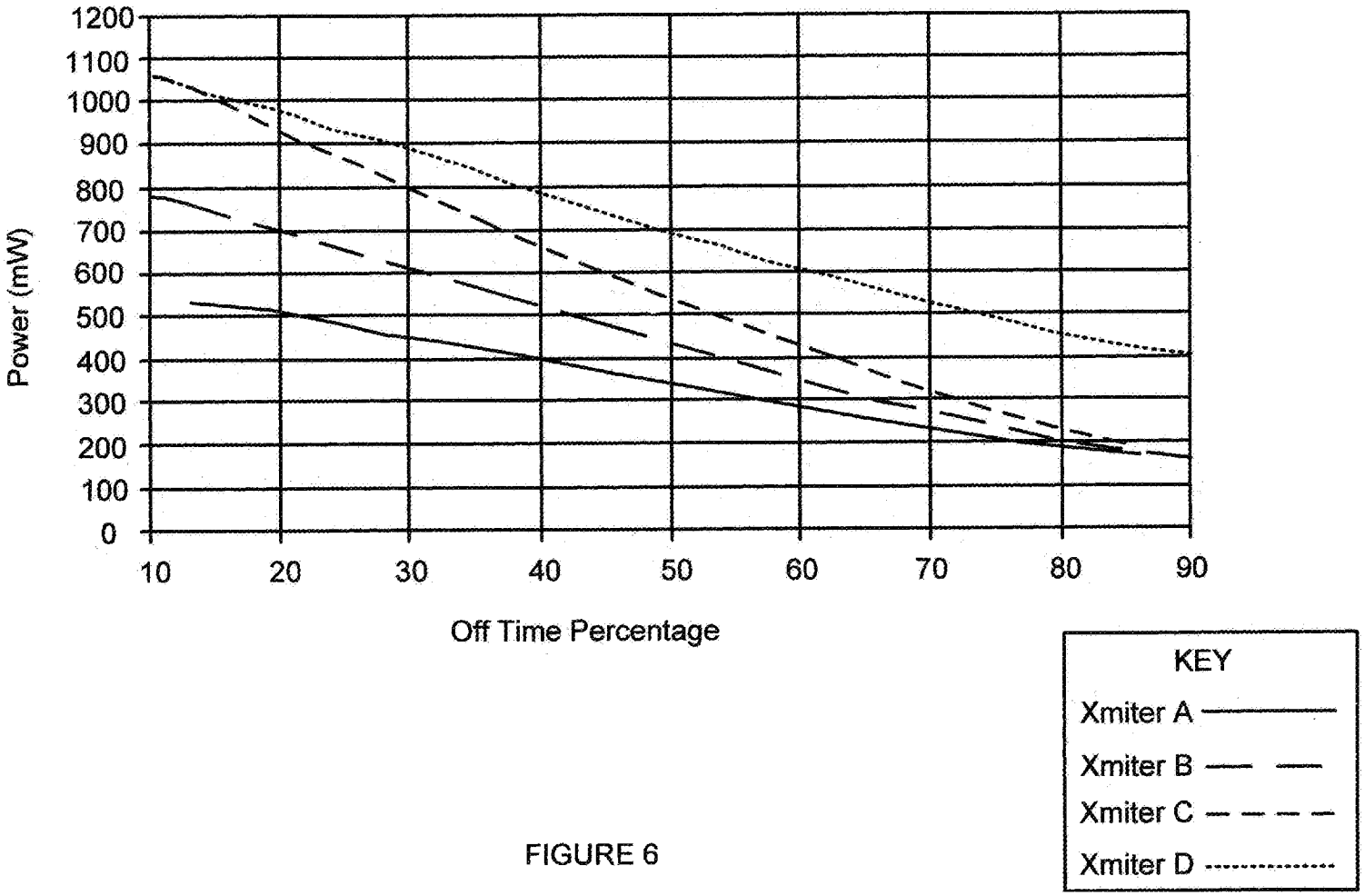
FIG. 6 is a graph illustrating plots for transmitter power consumption based on duty cycle off time percentage.

FIG. 6 is a graph including plots for transmitters A-D showing transmitter power consumption in milliwatts versus off time duty cycle in percentage. The plots are based on empirically measured data for four different transmitter models using an antenna having the same inductance. It should be evident on the basis of these plots that a range of transmitter output power can be achieved through duty cycle control alone.

The foregoing description of the invention has been presented for purposes of illustration and description. It is not intended to be exhaustive or to limit the invention to the precise form or forms disclosed, and other modifications and variations may be possible in light of the above teachings wherein those of skill in the art will recognize certain modifications, permutations, additions and sub-combinations thereof.

What is claimed is:

1. An apparatus for use with a system for performing an inground operation in which a drill string extends from a drill rig to an inground tool with the apparatus supported at least proximate to the inground tool during the inground operation, said apparatus comprising:

a transmitter configured for transmitting at least one locating signal from the transmitter including a carrier that is modulated to provide at least two different transmit power levels at least based on a duty cycle control of the carrier that is different for each different transmit power level.

2. The apparatus of claim 1 wherein said transmitter transmits the locating signal for at least one of locating the transmitter and characterizing an orientation of the transmitter.

3. The apparatus of claim 1 wherein said transmitter is configured for transmitting the locating signal based on one signal and driving the drill string as an electrical conductor based on another signal and said different power levels are applied to at least one of transmitting the locating signal and driving the drill string.

4. The apparatus of claim 1 wherein said transmitter is configured to use three or more different power levels for transmitting said locating signal.

5. The apparatus of claim 4 wherein the three or more power levels are separated by a stepwise increase from one power level to the next.

6. The apparatus of claim 1 wherein the transmitter is configured for controlling a gain level of the locating signal in conjunction with the duty cycle control to establish the different transmit power levels.

7. The apparatus of claim 1 wherein the transmitter is configured to change a duty cycle of the carrier for the duty cycle control based on a percentage of off time versus a percentage of on time of said carrier.

8. The apparatus of claim 7 wherein the percentage of off time versus the percentage of on time of the carrier changes by an equal percentage from one transmit power level to the next transmit power level.

9. A method for providing an apparatus for use with a system for performing an inground operation in which a drill string extends from a drill rig to an inground tool with the transmitter supported at least proximate to the inground tool during the inground operation, said method comprising:

configuring a transmitter as part of the apparatus for transmitting at least one locating signal therefrom including a carrier that is modulated to provide at least two different transmit power levels at least based on a duty cycle control of the carrier that is different for each different transmit power level.

* * * * *